US007124723B2

(12) United States Patent
Yokoyama et al.

(10) Patent No.: US 7,124,723 B2
(45) Date of Patent: Oct. 24, 2006

(54) VALVE MECHANISM FOR INTERNAL COMBUSTION ENGINE

(75) Inventors: Yu Yokoyama, Okazaki (JP); Shinichi Murata, Okazaki (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/303,919

(22) Filed: Dec. 19, 2005

(65) Prior Publication Data

US 2006/0130788 A1 Jun. 22, 2006

(30) Foreign Application Priority Data

Dec. 20, 2004 (JP) ..... 2004-368256

(51) Int. Cl.
*F01L 1/18* (2006.01)

(52) U.S. Cl. ..... 123/90.39; 123/90.16; 123/90.44

(58) Field of Classification Search ..... 123/90.39, 123/90.44, 90.16
See application file for complete search history.

(56) References Cited

U.S. PATENT DOCUMENTS 4,844,023 A 7/1989 Konno et al.
6,763,793 B1 * 7/2004 Murata et al. ..... 123/90.39
2003/0221645 A1 12/2003 Murata et al.
2004/0016413 A1 1/2004 Murata et al.
2004/0154569 A1 8/2004 Nagano et al.

FOREIGN PATENT DOCUMENTS

DE 4411182 A1 10/1995
DE 19637066 A1 3/1998
JP 7-77019 A 3/1995
JP 2003-343226 A 12/2003

* cited by examiner

*Primary Examiner*—Thomas Denion
*Assistant Examiner*—Ching Chang
(74) *Attorney, Agent, or Firm*—Birch, Stewart, Kolasch & Birch, LLP

(57) ABSTRACT

The present valve mechanism for an internal combustion engine makes it possible to reliably perform switching between the low-velocity operation mode and the high-velocity operation mode without delay. The valve mechanism includes: a first rocker arm which is supported by a rocker shaft in an oscillatory manner; a second rocker arm which is supported by the rocker shaft in an oscillatory manner; a cylinder provided for either said first rocker arm or said second rocker arm, said cylinder communicating with an oil passage; a first piston fitted in said cylinder in a slidable manner; an engaging protrusion provided in a protruding condition for the remaining one of said first rocker arm and said second rocker arm, said engaging protrusion being capable of engaging with said first piston; and a second piston which moves said first piston to an engaging position.

7 Claims, 3 Drawing Sheets

CONSTRUCTION OF
SWITCHING UNIT

VALVE MECHANISM FOR INTERNAL COMBUSTION ENGINE

BACKGROUND OF THE INVENTION (1) Field of the Invention

The present invention relates to a valve mechanism for an internal combustion engine, which valve mechanism is capable of opening and closing the intake valves and the exhaust valves of the internal combustion engine with different timings in accordance with the operation state of the engine.

(2) Description of the Related Art

Recently, a valve mechanism equipped with a variable valve lift and timing mechanism, in which the operational characteristics (open/close timing and open duration) of the intake valves and the exhaust valves of an internal combustion engine (hereinafter simply called "engine") can be selected according to the load state of the engine and the velocity state, has been developed and is in practical use.

In such a valve mechanism, as one of such mechanisms for selecting operation characteristics, a mechanism with two types of cams, one of which is a low-velocity cam whose cam profile is suitable for low-velocity operation of the engine and the other of which is a high-velocity cam whose cam profile is suitable for high-velocity operation of an engine, has been developed (e.g., see Japanese Patent Application Laid-open No. 2003-343226). Depending upon rotation state of the engine, the cams are selectively used to open and close the engine valves.

Now, referring to FIG. 3 through FIG. 5, a description will be made of a previous valve mechanism. As shown in FIG. 3 and FIG. 4, two intake valves 11 and 12 and two exhaust valves 21 and 22 are provided for the cylinder head 10 placed upward of each cylinder of the engine. To drive these intake valves 11 and 12 and exhaust valves 21 and 22, a valve mechanism 30 is prepared.

The valve mechanism 30 has an intake valve driving system for driving the intake valves 11 and 12 and an exhaust valve driving system for driving the exhaust valves 21 and 22. The intake valve driving system includes: a cam shaft 31; cams 31*a* through 31*c* fixed to the cam shaft 31; a rocker shaft 32; rocker arms 33 through 35 which are supported by the rocker shaft 32 in such a manner that the rocker arms 33 through 35 make a see-saw-like movement, following the rotation of the cams 31*a* through 31*c*. On the other hand, the exhaust valve driving system includes: a cam shaft 31 which is commonly used between the intake valve driving system and the exhaust valve driving system; cams 31*d* and 31*e* fixed to the cam shaft 31; rocker arms 37 and 38 which are supported by the rocker shaft 36 in such a manner that the rocker arms 37 and 38 (not illustrated in FIG. 4) make a see-saw-like movement, following the rotation of the cams 31*d* and 31*e*.

Further, at the intake valve driving system of the valve mechanism 30, a variable valve lift and timing mechanism 40 including a connection switching mechanism 41 is provided. A description will made hereinbelow of the variable valve mechanism 40.

Of the rocker arms 33 through 35 which drive the intake valves, at one end of each rocker arm 33 and 34, adjustment screws 33*a* and 34*a* are provided, respectively, through which adjustment screws 33*a* and 34*a* the ends of the stems of the intake valves 11 and 12 are made to come into contact with one end of each rocker arm 33 and 34, respectively. As a result, the intake valve 11 opens and closes in accordance with the see-saw-like movement of the rocker arm 33, and the intake valve 12 opens and closes in accordance with the see-saw-like movement of the rocker arm 34.

Further, at the other ends of the rocker arms 33 and 34, the rollers 33*b* and 34*b* are provided, respectively. The rollers 33*b* and 34*b* come into contact with the low-velocity cam 31*a* and 31*b*, respectively, each of which has a low-velocity cam profile for a low-velocity operation of the engine. When the rocker arms 33 and 34 make a see-saw-like movement in response to the rotation of the low-velocity cam 31*a* and 31*b*, the intake valves 11 and 12 open with characteristics suitable for low-velocity operation.

On the other hand, the rocker arm (second rocker arm) 35 has an engaging protrusion 35*a* which is capable of engaging with the rocker arms 33 and 34. The roller 35*b* provided at the other end of the rocker arm 35 comes into contact with a high-velocity cam 31*c* which has a high-velocity cam profile for a high-velocity operation of the engine.

In addition, as shown in FIG. 5(*a*) and FIG. 5(*b*), a cylinder 50 with an opening 53 is provided for the rocker arms 33 and 34 at a position at which one end of the rocker arm 35 comes into contact with the cylinder 50, and a piston 51 is fitted in the cylinder 50.

The cylinder 50 is constructed so that hydraulic oil (here, lubricating oil is commonly used) is supplied thereto from the rocker shaft 32 via an oil passage (communicating path) 32*b*. When hydraulic oil is supplied into the cylinder 50, the piston 51 is lifted by the supplied oil, as shown in FIG. 5(*b*), thereby closing the opening 53. Further, when the oil pressure in the cylinder 50 is released to the air, the piston 51 is pushed down by a force applied from the return spring 52, thereby opening the opening 53.

The piston 51 in the cylinder 50 and an oil pressure adjusting device (not illustrated) for adjusting oil pressure in the cylinder 50 form a connection switching mechanism 41 which selects the connection state between the rocker arms 33 and 34 and the rocker arm 35. The connection switching mechanism 41 and the intake valve driving system form a variable valve mechanism 40.

With the above-described arrangement, when the oil pressure in the cylinder 50 is exhausted by the oil pressure adjusting device, a space is formed at the opening 53 of the cylinder 50 [see FIG. 5(*a*)]. In this case, when the rocker arm 35 makes a see-saw-like movement, following the rotation of the high-velocity cam 31*c*, the engaging protrusion 35*a* enters the thus formed space, but does not come into contact with the rocker arm 33 or 34, so that the rocker arm 35 strikes at the air (rocker arm non-engagement) . Accordingly, the rocker arms 33 and 34 make see-saw-like movements, following the rotation of the low-velocity cams 31*a* and 31*b*, respectively. As a result, the intake valves 11 and 12 are opened and closed with characteristics suitable for low-velocity operation of the engine (low-velocity operation mode).

On the other hand, when oil pressure in the cylinder 50 is increased by the oil pressure adjusting device, the piston 51 is lifted up, thereby entering an engaged state, and the opening 53 of the cylinder 50 is closed by the piston 51 [see FIG. 5(*b*)]. Thus, when the rocker arm 35 makes a see-saw-like movement, the engaging protrusion 35*a* provided at one end of the rocker arm 35 comes into contact with the side surface (engaging surface) 54 of the piston 51, and makes the rocker arms 33 and 34 develop a see-saw-like movement (rocker arm engagement). In this instance, the rocker arms 33 and 34 are driven by the rocker arm 35, while being separated from the low-velocity cam 31*a* and 31*b*, and move following the rotation of the cam shaft 31*c*, thereby opening and closing the intake valves 11 and 12 with characteristics suitable for high-velocity operation of the engine (high-velocity operation mode).

Here, in the above-described previous art, the piston 51 needs to have a comparatively large diameter, partly because a space large enough to make sure that the rocker arm 35 strikes the air is necessary during a low-velocity operation mode (at the time when the rocker arm is not engaged), and also partly because a space for arranging the return spring 52 which pushes down the piston 51 is necessary.

However, a large piston diameter increases the volume of oil necessary for switching operation modes (in particular, when switching from the high-velocity operation mode to the low-velocity operation mode), so that a longer time is required for switching the operation mode. Additionally, the engagement state between the piston 51 and the engaging protrusion 35*a* of the rocker arm 35 can be incomplete, so that the piston 51 is knocked out when it is being lifted due to a reactive force which drives a valve. As a result, the engaging protrusion 35*a* enters the opening, thereby switching the operation mode of the engine into the low-velocity operation mode.

Further, if the piston 51 is knocked out, the rocker arms 33 and 34 collides with the cam, thereby causing a knocking sound. If the impact is strong, the rollers 34*a* and 34*b* may be damaged.

With the foregoing problems in view, it is an object of the present invention to provide a valve mechanism for an internal combustion engine, with which valve mechanism it is possible to reliably perform switching between the low-velocity operation mode and the high-velocity operation mode without delay.

SUMMARY OF THE INVENTION

With the foregoing problems in view, it is an object of the present invention to provide a valve mechanism for an internal combustion engine, comprising: a first rocker arm whose end is connected to either an intake valve or an exhaust valve, the first rocker arm being supported by a rocker shaft in an oscillatory manner and being driven by a first cam; a second rocker arm provided adjacently to the first rocker arm, the second rocker arm being supported by the rocker shaft in an oscillatory manner and being driven by a second cam whose shape is different from that of the first cam; a cylinder provided for either the first rocker arm or the second rocker arm, the cylinder communicating with an oil passage, which is formed through the rocker shaft, by way of a communicating path formed through the wall of the oil passage; a first piston fitted in the cylinder in a slidable manner; an engaging protrusion provided in a protruding condition for the remaining one of the first rocker arm and the second rocker arm, the engaging protrusion being capable of engaging with an engaging part of the first piston; a return spring which applies a force to the first piston for impelling the first piston to a position where the first piston does not engage with the engaging protrusion; and a second piston which is moved by hydraulic oil supplied from the oil passage so as to move the first piston to an engaging position where the first piston engages with the engaging protrusion, the movement being made against the force applied by the return spring.

As a generic feature, there is provided a valve mechanism for an internal combustion engine, comprising: a first rocker arm whose end is connected to either an intake valve or an exhaust valve, the first rocker arm being supported by a rocker shaft in an oscillatory manner and being driven by a first cam; a second rocker arm provided adjacently to the first rocker arm, the second rocker arm being supported by the rocker shaft in an oscillatory manner and being driven by a second cam whose shape is different from that of the first cam; a cylinder provided for the second rocker arm, the cylinder communicating with an oil passage, which is formed through the rocker shaft, by way of a communicating path formed through the wall of the oil passage; a first piston fitted in the cylinder in a slidable manner; an engaging protrusion provided for the first rocker arm in a protruding condition, the engaging protrusion being capable of engaging with an engaging part of the first piston; a return spring which applies a force to the first piston for impelling the first piston to a position where the first piston does not engage with the engaging protrusion; and a second piston which is moved by hydraulic oil supplied from the oil passage so as to move the first piston to an engaging position where the first piston engages with the engaging protrusion, the movement being made against the force applied by the return spring.

The following advantageous effects are guaranteed according to the valve mechanism of the internal combustion engine of the present invention. That is, it is possible to reduce the volume of oil necessary for switching the position of the first piston by use of the second piston, so that the time required for switching the position of the first piston (in particular, when switching from the non-engaging position to the engaging position) is considerably reduced.

Other objects and further features of the present invention will be apparent from the following detailed description when read in conjunction with the accompanying drawings.

BRIEF DESCRIPTION OF THE DRAWINGS

FIG. 1(*b*) is a schematic sectional view showing an important part of a valve mechanism for an internal combustion engine according to one preferred embodiment of the present invention, when the piston is positioned at an engaged position;

FIG. 5(*b*) is a diagram for describing a previous art of the present invention, and shows an engaged state of the rocker arm.

DESCRIPTION OF THE PREFERRED EMBODIMENT(S)

Referring to the relevant drawings, one preferred embodiment of the present invention will be described hereinbelow.

Figure 4:
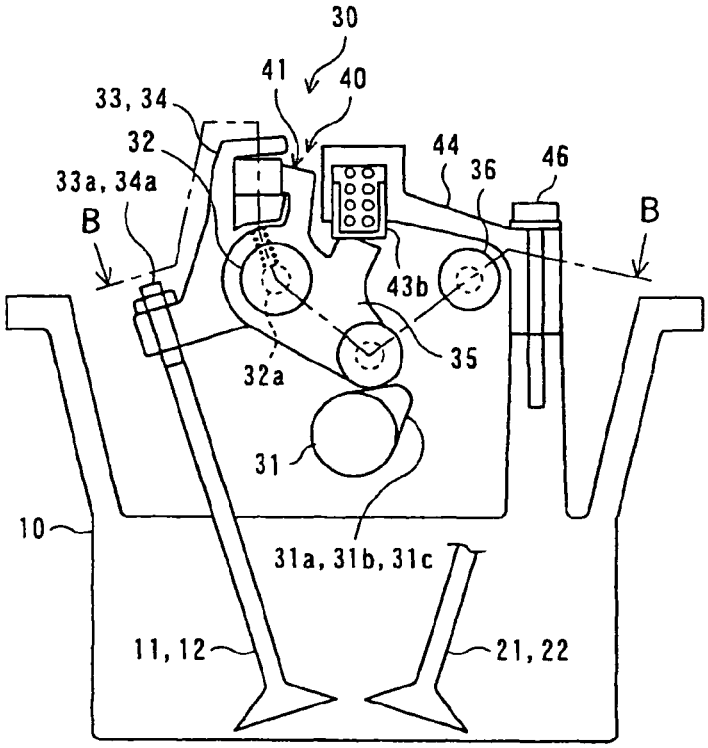
FIG. 4 PRIOR ART
FIG. 4 is a diagram for describing a previous art of the present invention, and is a schematic side view showing the inside of a cylinder head.
Figure 5A:
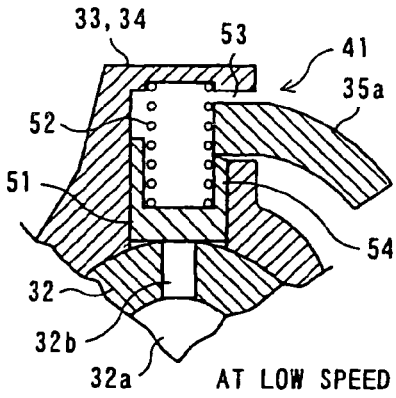
FIG. 5(a) PRIOR ART
FIG. 5(*a*) is a diagram for describing a previous art of the present invention, and shows a non-engaged state of a rocker arm.
Figure 5B:
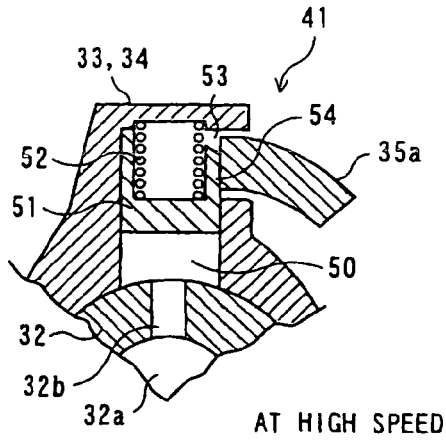
FIG. 5(b) PRIOR ART

The following description will be made with reference to FIG. 3 through FIG. 5, which are used in the above description of the previous art.

A characteristic feature of the present valve mechanism is a mechanism for switching the position of a piston. The valve mechanism is similar to the previous art in construction (already described with reference to FIG. 3 and FIG. 5) except for this valve mechanism.

Figure 3:
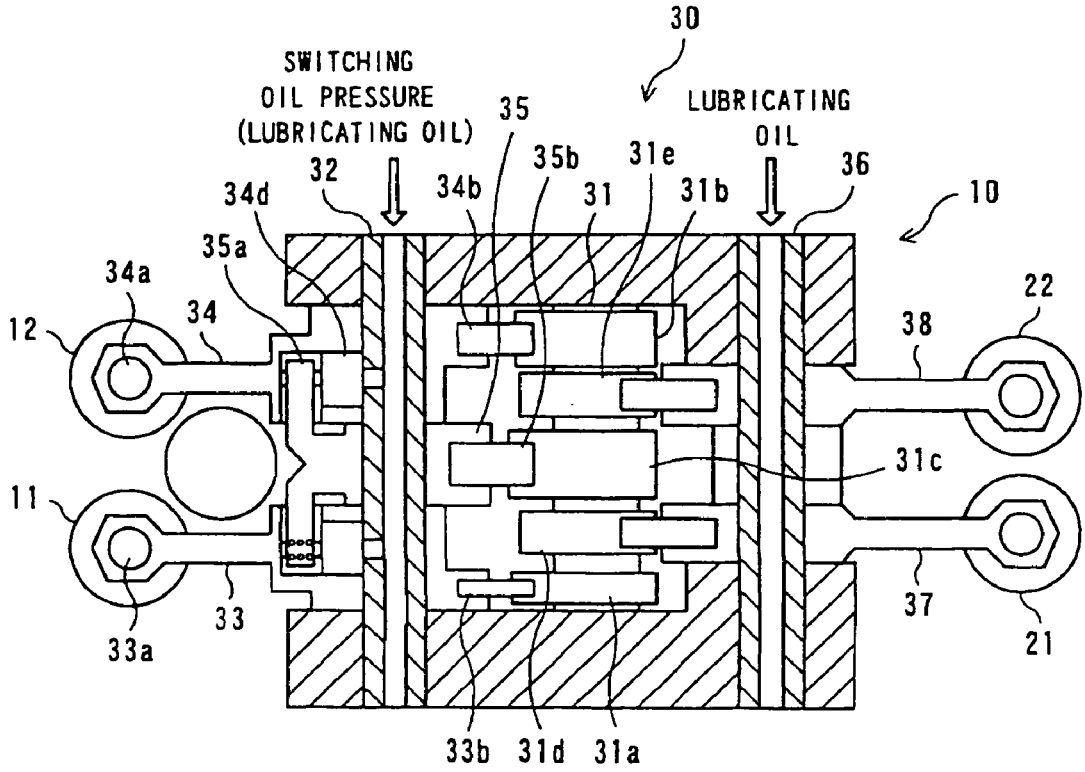
FIG. 3 PRIOR ART
FIG. 3 is a diagram for describing a previous art of the present invention, and a view taken along the B—B arrow of FIG. 4.

More specifically, as shown in FIG. 3, the cylinder head 10 above each cylinder of an engine is provided with two intake valves 11 and 12 and two exhaust valves 21 and 22. To drive the intake valves 11 and 12 and exhaust valves 21 and 22, there is provided a valve mechanism 30.

The valve mechanism 30 can be divided into two systems: an intake valve driving system for driving the intake valves 11 and 12; and an exhaust valve driving system for driving the exhaust valves 21 and 22.

The intake valve diving system includes: a cam shaft 31; cams 31*a* through 31*c* fixed to the cam shaft 31; an intake rocker shaft 32; and rocker arms 33 through 35 supported by the rocker shaft 32 in a oscillatory manner, which rocker arms 33 through 35 undulate so as to move like a see-saw, following the rotation of the cams 31*a* through 31*c*.

The exhaust valve driving system includes: a cam shaft 31 which is commonly used between the intake and the exhaust valve driving system; cams 31*d* and 31*e* fixed to the cam shaft 31; an exhaust rocker shaft 36; rocker arms 37 and 38 supported by the rocker shaft 36 in a oscillatory manner, which rocker arms 33 through 35 undulate so as to move like a see-saw, following the rotation of the cams 31*d* through 31*e*.

A variable valve lift and timing mechanism 40 with a connection switching mechanism 41 is provided for an intake valve driving system of the valve mechanism 30.

More specifically, of the rocker arms 33 through 35 for driving an intake valve, rocker arms (first rocker arm) 33 and 34 have adjustment screws 33*a* and 34*a* at one end thereof, and the adjustment screws 33*a* and 34*a* are made to come into contact with the ends of the intake valves 11 and 12. The intake valve 11 opens and closes in accordance with a seesaw-like movement of the rocker arm 33, and the intake valve 12 opens and closes in accordance with a seesaw-like movement of the rocker arm 34.

At the other ends of the rocker arms 33 and 34 are placed rollers 33*b* and 34*b*. These rollers 33*b* and 34*b* are made to come into contact with low velocity cams (first cam) 31*a* and 31*b*, respectively, formed in a low-velocity cam profile for a low-velocity operation of the engine. When the rocker arms 33 and 34 make seesaw-like movements following the rotation of the cams 31*a* and 31*b*, the intake valves 11 and 12 open and close with characteristics suitable for low-velocity operation.

On the other hand, the rocker arm (second rocker arm) 35 has engaging protrusions 35*a* thereof, which are provided at one end thereof and are capable of engaging with the rocker arms 33 and 34. A roller 35*b* provided at the other end thereof is made to come into contact with a high-velocity cam (second cam) 31*c* formed to have a high-velocity cam profile for high-velocity operation of the engine.

Figure 1A:
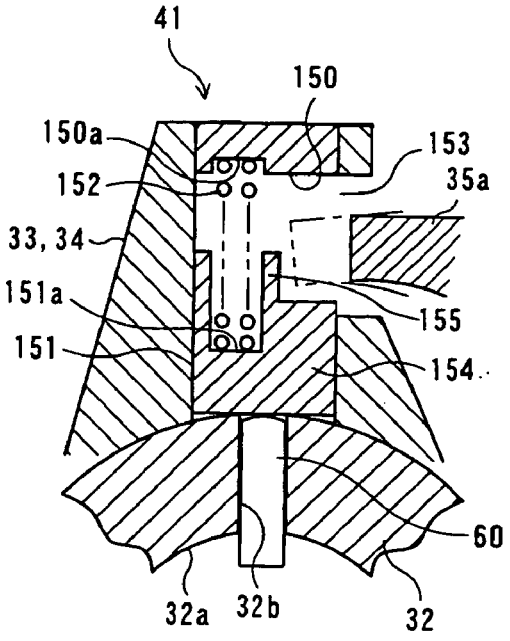
FIG. 1(*a*) is a schematic sectional view showing an important part of a valve mechanism for and internal combustion engine according to one preferred embodiment of the present invention, when a piston is positioned at a non-engaged position.
Figure 1B:
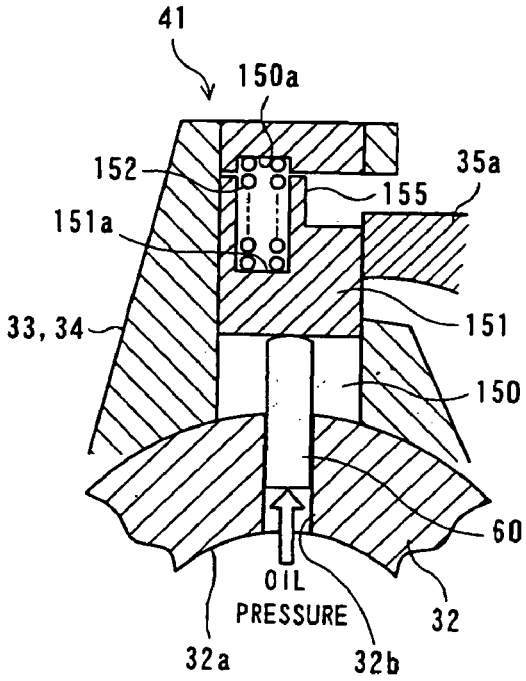

In addition, as shown in FIG. 1(*a*) and FIG. 1(*b*), on a part of the rocker arms 33 and 34, which part faces one end of the rocker arm 35, a cylinder 150 with an opening 153 thereof is formed, and a piston 151 (first piston) is fitted in the cylinder 150. In this instance, the opening 153 should by no means be limited to the shape of the present embodiment, and the opening 153 can have any shape as long as it can provide a space in which the engaging protrusion 35*a* can undulate so as to move like a see-saw.

Further, an oil passage 32*a* passes through the rocker shaft 32, to which oil passage 32 hydraulic oil (here, lubrication oil is commonly used) is supplied from an oil pressure source. In addition, the intake rocker shaft 32 has a communicating path 32*b* formed along the radial direction thereof, through which communication path 32*b* the oil passage 32*a* communicates with the cylinder 150.

In addition, a pin (second piston) 60 whose diameter is smaller than that of the piston 151 is inserted into the communicating path 32*b* in such a manner that the pin 60 can move back and forth. This pin 60 is formed to have a diameter slightly smaller than that of the communicating path 32*b*. When the hydraulic oil pressure is low, the pin 60 is held in the intake rocker shaft 32. On the other hand, when the hydraulic oil pressure is increased, the pin 60 can be partly pushed out of the rocker shaft 32, maintaining fluid tightness in the communicating path 32*b*.

Further, the upper end of the pin 60 is formed to be roundish, and it is preferable that the upper end forms a part of a spherical surface.

If the pin 60 is partly pushed out of the communicating path 32*b*, the upper end of the pin 60 comes into contact with the piston 151, and pushes up the piston 151, resisting a force applied by a return spring 152. As a result, as shown in FIG. 1(*b*), the piston 151 is moved to a position such that the piston 151 closes the opening 153.

If the oil pressure is reduced by exposing the inside of the oil passage 32*a* to air, the piston 151 and the pin 60 are pushed down by a force applied by the return spring 152 as shown in FIG. 1(*a*), so that the opening 153 is opened.

The piston 151 in the cylinder 150, the pin 60 which comes into contact with the piston 151 and selects the position of the piston 151, and a non-illustrated oil pressure adjusting device for adjusting the oil pressure within the communicating path 32*b*, form a connection switching mechanism 41 which selects the connection state between the rocker arms 33 and 34 and the rocker arm 35. This connection switching mechanism 41 and the intake valve driving system form a variable valve lift and timing mechanism 40.

With this arrangement, when the oil pressure in the oil passage 32*a* is decreased, the piston 151 moves downwards [see FIG. 1(*a*)], so that a space is provided at the opening 153 of the cylinder 150. In this case, if the rocker arm 35 makes a see-saw-like movement, the engaging protrusion 35*a* enters the above-mentioned space but does not come into contact with the rocker arm 33 or 34, so that the rocker arm 35 strikes at the air (non-engagement of rocker arms). Accordingly, the rocker arms 33 and 34 make a see-saw-like movement in response to the rotation of their corresponding cams 31*a* and 32*b*, respectively, so that the intake valves 11 and 12 are driven to open and close with characteristics suitable for low-velocity operation (low-velocity operation mode).

On the other hand, when the oil pressure in the oil passage 32*a* is increased, the piston 151 is pushed up and protrudes into the cylinder 150, and the opening 153 of the cylinder 150 is closed by the piston 151 [see FIG. 1 (*b*)]. Accordingly, when the rocker arm 35 makes a see-saw-like movement, the engaging protrusion 35*a* provided at one end of the rocker arm 35 comes into contact with the piston 151, thereby causing the rocker arms 33 and 34 to be lubricated via the piston 151. At this time, the rocker arms 33 and 34, being separated from their corresponding cams 31*a* and 31*b*, respectively, are driven by the rocker arm 35 to make a see-saw-like movement in response to the rotation of a high-velocity cam 31*c*, and make the intake valves 11 and 12 open and close with characteristics suitable for high-velocity operation of the engine (high-velocity operation mode).

Here, the upper end of the pin 60 has a roundish shape or the shape of a part of a spherical surface, so as to reduce the sliding resistance of the pin 60 due to the see-saw-like movement of the rocker arms 33 and 34 in the high-velocity operation mode.

With such an arrangement of the valve mechanism for an internal combustion engine of the present embodiment, when the oil pressure in the oil passage 32*a* is increased by the oil pressure adjusting device, the pin 60 is pushed up and lifts the piston 151. As a result, the piston 151 protrudes into the cylinder 150 [see FIG. 1(*b*)], thereby positioning the engaging surface 154 of the piston 151 at the opening 153 of the cylinder 150. Thus, when the rocker arm 35 makes a see-saw-like movement, the engaging protrusion 35*a* at one end of the rocker arm 35 comes into contact with the engaging surface 154, and makes the rocker arms 33 and 34 become lubricated via the piston 151. That is, the connection switching mechanism 41 comes into a connection state, and the intake rocker arms 33 and 34 and the rocker arm 35 integrally make a see-saw-like movement, thereby opening and closing the intake valves 11 and 12 in accordance with the cam profile of the high-velocity cam 31*c*. That is, the engine comes into a high-velocity operation mode.

When the oil pressure in the oil passage 32*a* is decreased, the piston 151 and the pin 60 are pushed down by a force applied by the return spring 152 [see FIG. 1(*a*)]. As a result, a space is formed at the opening 153 of the cylinder 150. Thus, when the rocker arm 35 makes a see-saw-like movement, the engaging protrusion 35*a* at one end of the rocker arm 35 enters the thus formed space, and does not come into contact with the rocker arms 33 and 34. This makes the connection switching mechanism 41 into a separate state, and the rocker arms 33 and 34 make a see-saw-like movement independently from the rocker arm 35. That is, the engine comes into a low-velocity operation mode in which the intake valves 11 and 12 are driven to open and close in accordance with the cam profile of a low-velocity cam 31*a* or a low-velocity cam 31*b*.

In particular, in the present mechanism, since the connection switching mechanism 41 is constructed in the form of a so-called two-stage piston, in which the position of the piston 151 is selected in accordance with the positional change of the pin 60, it is possible to reliably switch the position of the piston 151.

That is, the position of the piston 151 is selected by the oil pressure generated at the bottom surface of the pin 60 which is closer to the oil passage, without the necessity of the oil pressure directly generated at the bottom surface of the piston 151. Hence, it is possible to improve the response at the time the position of the piston 151 is changed.

Further, in cases where the position of the piston 151 is directly changed by the oil pressure (in particular, when the operation mode is switched from the low-velocity operation mode to the high-velocity operation mode), a volume of oil obtained as the product of the bottom surface area S1 (equal to the piston diameter R1) and the piston stroke L is necessary. Here, if the volume of oil necessary for changing the position of the piston 151 can be reduced, it is possible to reduce the time necessary for changing the position of the piston 151. That is, reduction of the necessary oil volume makes it possible to change the position of the piston 151 by using a smaller volume of hydraulic oil, so that the response at the time of positional change of the piston 151 is improved.

However, allowing for the hardness required by the piston 151, it is difficult to reduce the diameter of the piston 151, so that it is also difficult to reduce the volume of oil necessary to change the position of the piston 151.

In view of this, the present invention employs a two-stage piston construction equipped with a pin 60 with a small diameter provided downward of the piston 151. With such a construction, the volume of oil necessary for moving the piston 151 is obtained as the product of the bottom surface area S2 (equal to the diameter of the pin 60) and the stroke amount L. Thus, the construction is advantageous in that by making the diameter of the pin 60 smaller than that of the piston 151, the time required for changing the position of the piston 151 (in particular, when the engine is switched from the low-velocity operation mode to the high-velocity operation mode) is shortened.

Further, when oil is made to flow into the cylinder 50, from the oil passage 32*a* of the rocker shaft 32 via the communicating path 32*b*, a see-saw-like movement of a rocker arm tends to cause turbulence in the flow of the oil, so that there is some probability that the time required for changing the position of the piston 151 becomes difficult to reduce.

In view of this, the present invention employs the pin 60 arranged in the rocker shaft 32. This arrangement makes it possible to reliably supply hydraulic oil, thereby reducing the time required for changing the position of the piston 151. This is because the pin 60 is directly supplied with the oil pressure in the oil passage 32*a* of the rocker shaft 32 which is fixed to the engine body, so that the oil itself will not be shaken by a see-saw-like movement of the rocker arm.

As a result, the following problem of the previous art can be solved. That is, the piston 151 and the engaging protrusion 35*a* of the rocker arm 35 are partly engaged, and the piston 151 is knocked out, during the process of being lifted, by the engaging protrusion 35*a* due to a reaction force driving the valve so that the engine resultantly comes into a low-velocity operation mode. In addition, the occurrence of the sound of collision or hitting between the rocker arms 33 and 34 and the cam due to the piston 151 being knocked out can be restrained, so that the durability of the roller 34*a* and 34*b* is considerably improved.

In addition, since the upper end of the pin 60 is roundish or takes the shape of apart of a spherical surface, the slide resistance between the pin 60 and the rocker arms 33 and 34 can be reduced, so that further high-speed rotation becomes possible.

Next, referring to FIG. 2, a modification of the present embodiment will be described herein below. In this modified example, the positions of the cylinder 150 and the piston 151 are different from those in the above embodiment.

More specifically, in the above embodiment, the cylinder 150, piston 151, pin 60, and return spring 152 are provided for the rocker arms 34 and 35 which are driven by the low-velocity cam 31*a* and 31*b* (see FIG. 3). In the modified example, the cylinder 150, piston 151, pin 60, and return spring 152 are provided for the second rocker arm 35 which is provided adjacently to the rocker arms 33 and is driven by the high-velocity cam shaft 31*c* (see FIG. 1), and engaging protrusions 33' and 34' are provided for the rocker arm 33 and 34. Except for these points, the construction of the modified example is similar to that of the above-described embodiment.

Such a modified construction realizes effects and benefits similar to those of the above-described embodiment. That is, increase in the oil pressure of the rocker shaft 32 lifts the pin 60, which then pushes up the piston 151. When the rocker arm 35 makes a see-saw-like movement, the rocker arms 33 and 34 are rotationally driven via the piston 151 (high-velocity operation mode).

Further, if the oil pressure in the oil passage 32*a* is lowered, the piston 151 and the pin 60 come down, and a space is resultantly made at the opening of the cylinder 150. When the rocker arm 35 makes a see-saw-like movement, the engaging protrusions 33' and 34' of the rocker arms 33 and 34 enter the thus-created space, and the rocker arms 33 and 34 are rotationally driven (low-velocity mode) according to the cam profile of the low-velocity cam 31*a* or the low-velocity cam 31*b*, without being influenced by the rocker arm 35.

In addition, the volume of oil necessary for moving the piston 151 is given as a product of the bottom surface S2 (equal to the diameter of the pin 60) of the pin 60 and the stroke amount L. Thus, by making the diameter of the pin 60 smaller than that of the piston 151, switching time of the piston 151 is shortened.

With this arrangement, it is possible to prevent the following accident. That is, after the piston 151 and the engaging protrusions 33' and 34' are partly engaged, the piston 151 is knocked out by the engaging protrusions 33' and 34, whereby the engine goes into the low-velocity operation mode. The occurrence of the sound of collision or hitting between the rocker arms 33 and 34 and the cam due to the piston 151 being knocked out can be restrained, so that durability is considerably improved.

Figure 2:
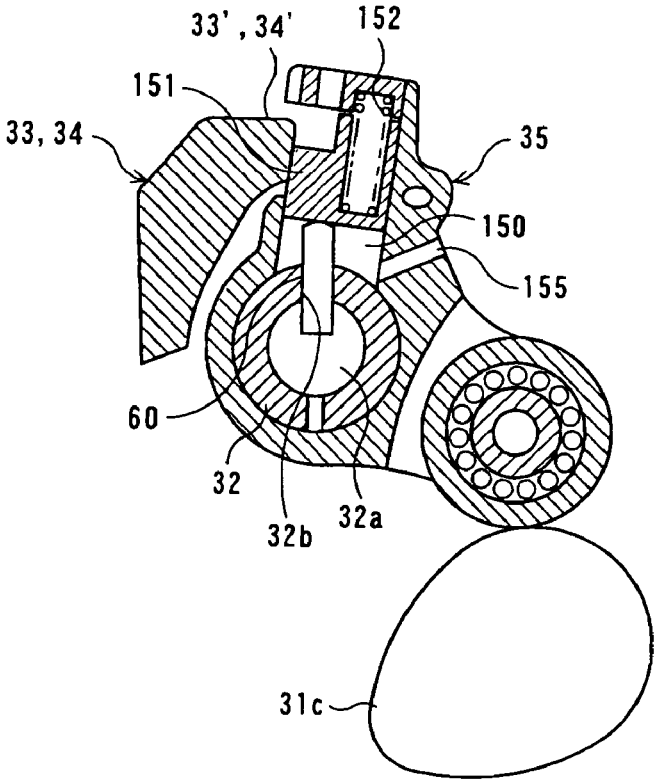
FIG. 2 is a schematic sectional view showing a modified example of the valve mechanism for an internal combustion engine according to the present embodiment.

Here, as shown in FIG. 2, the respiration opening 155 communicating with the outside, which opening is provided between the piston 151 in the cylinder 150 and the pin 60, reduces the backpressure of the piston 151 and the pin 60, so that switching time is thoroughly reduced.

As described so far, one preferred embodiment of the present invention and its modified example are described, but the present invention should by no means be limited to the above-illustrated embodiment, and various changes or modifications may be suggested without departing from the gist of the invention. For example, the length of the second piston (pin) 60 is changeable depending upon the stroke amount of the piston 151 or the diameter of the oil passage 32*a*, or the length of the communicating path 32*b*.

What is claimed is:

1. A valve mechanism for an internal combustion engine, comprising:

a first rocker arm whose end is connected to either an intake valve or an exhaust valve, said first rocker arm being supported by a rocker shaft in an oscillatory manner and being driven by a first cam;

a second rocker arm provided adjacently to said first rocker arm, said second rocker arm being supported by the rocker shaft in an oscillatory manner and being driven by a second cam whose shape is different from that of the first cam;

a cylinder provided for either said first rocker arm or said second rocker arm, said cylinder communicating with an oil passage, which is formed through said rocker shaft, by way of a communicating path formed through the wall of the oil passage;

a first piston fitted in said cylinder in a slidable manner;

an engaging protrusion provided in a protruding condition for the remaining one of said first rocker arm and said second rocker arm, said engaging protrusion being capable of engaging with an engaging part of said first piston;

a return spring which applies a force to said first piston for impelling said first piston to a position where said first piston does not engage with said engaging protrusion; and a second piston which is moved by hydraulic oil supplied from the oil passage so as to move said first piston to an engaging position where said first piston engages with said engaging protrusion, said movement being made against the force applied by said return spring.

2. A valve mechanism as set forth in claim 1, wherein said second piston has a diameter smaller than that of said first piston.

3. A valve mechanism as set forth in claim 2, wherein said second piston is arranged so that said second piston is capable of moving forwards and backwards in the communicating path.

4. A valve mechanism as set forth in claim 1, wherein said second piston has a roundish upper end thereof.

5. A valve mechanism as set forth in claim 2, wherein said second piston has a roundish upper end thereof.

6. A valve mechanism as set forth in claim 3, wherein said second piston has a roundish upper end thereof.

7. A valve mechanism as set forth in claim 1, wherein a respiration opening, which makes the inside of said cylinder communicate with the outside of said cylinder, is provided at a position which is interposed between the said first piston and said second piston when said first piston is at an non-engaging position.

* * * * *